US005599013A

United States Patent [19]

Detmers et al.

[11] Patent Number: 5,599,013

[45] Date of Patent: Feb. 4, 1997

[54] PAPER SHEET GUIDING CYLINDER FOR A PRINTING MACHINE

[75] Inventors: Andreas Detmers, Mauer; Karl-Heinz Filsinger, Wiesloch, both of Germany

[73] Assignee: Heidelberger Druckmaschinen AG, Heidelberg, Germany

[21] Appl. No.: 375,963

[22] Filed: Jan. 20, 1995

Related U.S. Application Data

[63] Continuation of PCT/EP93/01542, Jun. 17, 1993.

[30] Foreign Application Priority Data

Jul. 20, 1992 [DE] Germany ..... 42 23 839.0

[51] Int. Cl.[6] ..... B65H 29/24

[52] U.S. Cl. ..... 271/195; 101/420

[58] Field of Search ..... 271/194, 195, 271/204, 205, 184, 276; 101/420; 406/88

[56] References Cited

U.S. PATENT DOCUMENTS

| | | | |
|---|---|---|---|
| 2,138,178 | 11/1938 | Lang | 271/195 |
| 4,479,645 | 10/1984 | Pollich | 271/195 |
| 4,815,379 | 3/1989 | Becker et al. | 101/420 |
| 4,836,104 | 6/1989 | Duarte | 271/195 |
| 4,967,661 | 11/1990 | Duarte | 271/195 |
| 5,222,726 | 6/1993 | Vits . | |

FOREIGN PATENT DOCUMENTS

| | | | |
|---|---|---|---|
| 3536444 | 5/1986 | Germany . | |
| 3638452 | 10/1987 | Germany . | |
| 230713 | 4/1944 | Switzerland . | |
| 477042 | 12/1937 | United Kingdom . | |
| 2116510 | 9/1983 | United Kingdom . | |
| 89/09177 | 10/1989 | WIPO . | |
| 9402399 | 2/1994 | WIPO | 271/195 |

*Primary Examiner*—H. Grant Skaggs

*Attorney, Agent, or Firm*—Herbert L. Lerner; Laurence A. Greenberg

[57] ABSTRACT

A printing machine has side frames and a printing machine drive. A paper sheet guiding cylinder is mounted in the side frames of the printing machine, is drivingly connected to the printing machine drive and has an axis. The paper sheet guiding cylinder includes a cylindrical casing and side walls with through holes formed therein. The paper sheet guiding cylinder has a rotatably mounted radial ventilator being coaxial with the axis of the paper sheet guiding cylinder for supplying blowing air into the paper sheet guiding cylinder and for deflecting the blowing air inside the paper sheet guiding cylinder towards the cylindrical casing. The radial ventilator has end surfaces communicating with the ambient air through the holes and ventilator blades being disposed concentrically about the axis of the paper sheet guiding cylinder and extending along the paper sheet guiding cylinder. A drive for the paper sheet guiding cylinder has adjustable speed and is independent of the paper sheet guiding cylinder.

10 Claims, 6 Drawing Sheets

1
2
3
4
6
8
9
10
11
16
18
20
22
41
42
A 1
3
4
8
9
16
20
23
36
41
42
2

PAPER SHEET GUIDING CYLINDER FOR A PRINTING MACHINE

CROSS-REFERENCE TO RELATED APPLICATION

This application is a Continuation of International Application Serial No. PCT/EP93/01542, filed Jun. 17, 1993.

BACKGROUND OF THE INVENTION

Field of the Invention

The invention relates to a paper sheet guiding cylinder for a printing machine that is mounted in side frames of the machine, and has a driving connection to a printing machine drive, a casing surface provided with through holes, means for supplying blowing air into the paper sheet guiding cylinder, and means located inside the paper sheet guiding cylinder for deflecting the blowing air in the direction of the cylindrical casing.

Paper sheet guiding cylinders are known in the art to be used in printing machines to transport printed paper sheets between printing units or in a deliver section. The paper sheet should also be guided stably and smear-free with printed sheets having a printed side which is oriented towards the outer casing of the latter sheet guiding cylinder. The outer casings are also known in the art to be provided with expensive special coatings. The paper sheet guiding cylinders are additionally known in the art to be provided with blowing air passed from their interior to the outer casing and to the exterior by means of blow jets being oriented towards and connected non-rotatably to the paper sheet guiding cylinder and with a complex external blowing air supply. The blowing air jets only cover a certain part of the paper sheet guiding area. In order to cover a larger part of the paper sheet guiding area it is necessary to place several rows of blow jets in close succession one after the other. The external blowing air supply requires a large number of sealing means, air supply means and a complex blowing air control system.

According to German Published, Non-Prosecuted Application DE 36 38 452 A1 it is also known to place air blades for deflecting the blowing air to the exterior inside a paper sheet guiding cylinder and to non-rotatably connect the air blades to the paper sheet guiding cylinder. It is possible to use such air blades to adequately supply the cylinder surface with an air cushion at high speeds in such a way that the printed side of a paper sheet does not come into contact with the outer casing of the paper sheet guiding cylinder and therefore to largely avoid smearing effects. However, when printing conditions are altered and at low speeds in particular, the air supply is not enough to prevent further touching contacts. Therefore, wide working areas, for example proof printing or production run printing of highly accurate special orders that are usually printed at slow speeds, cannot be reliably transported free from smears. On one hand, if the machine stops suddenly the paper sheets can simply collapse under their own weight and in critical areas can even stick to the outer casings of the paper sheet guiding cylinder. On the other hand, at very high speeds that go beyond the narrow speed range of stable smear-free paper sheet guiding, the air cushion easily becomes too thick and additionally because of breakaway effects of the flow, the paper sheets can flutter and can also contact paper sheet guiding surfaces with their printed sides.

SUMMARY OF THE INVENTION

It is accordingly an object of the invention to provide a paper sheet guiding cylinder for a printing machine, which overcomes the hereinafore-mentioned disadvantages of the heretofore-known devices of this general type and which achieves a stable guiding of printed paper-sheets with simple means.

With the foregoing and other objects in view there is provided, in accordance with the invention, in a printing machine having side frames and a printing machine drive, a paper sheet guiding cylinder assembly comprising a paper sheet guiding cylinder being mounted in the side frames of the printing machine and being drivingly connected to the printing machine drive; the paper sheet guiding cylinder having an axis; the paper sheet guiding cylinder including a cylindrical casing and side walls with through holes formed therein; the paper sheet guiding cylinder having a rotatably mounted radial ventilator being coaxial with the axis of the paper sheet guiding cylinder for supplying blowing air into the paper sheet guiding cylinder and for deflecting the blowing air inside the paper sheet guiding cylinder towards the cylindrical casing, the radial ventilator having end surfaces communicating with the ambient air through through the holes, and ventilator blades being disposed concentrically about the axis of the paper sheet guiding cylinder and extending along the paper sheet guiding cylinder; and means being independent of the paper sheet guiding cylinder for driving the radial ventilator with adjustable speed.

The radial ventilator that is rotatably mounted in relation to and is driven independently of the paper sheet guiding cylinder facilitates stable paper sheet guiding over the full working area. Both during a machine stop as well as during very high speeds, an air cushion that is necessary for stable paper sheet guiding can be set individually because of the radial ventilator speed control that is independent from the paper sheet guiding cylinder. Even in the event of a very abrupt machine stop, the side of the printed paper sheet can be prevented from sticking to the paper sheet guiding cylinder. Stable paper sheet guiding is guaranteed over the full paper sheet guiding cylinder. The through holes in the front walls of the paper sheet guiding cylinder facilitate an adequate air supply without additional external complexity. The large amount of maintenance and assembly work involved by external air supply means becomes redundant. Stable paper sheet guiding is achieved by simple means. No additional provision of space for complex air supply means is necessary. The complexity of the control system for controlling the radial ventilator is low as compared with the known control system for external supply. The reduction in smearing effect leads to a reduction in paper wastage, an improvement in the quality of the printed paper sheets because of the absence of ink carry-over onto subsequent paper sheets and a reduction in the amount of cleaning needed for the paper sheet cylinder.

In accordance with another feature of the invention, the radial ventilator has sides facing the side walls of the paper sheet guiding cylinder and inlet nozzles non-rotatably connected with the radial ventilator on at least one of the sides of the radial ventilator. This embodiment facilitates an additional improvement in the supply of air to the radial ventilator, thus improving the adjustability of the desired cushion of air and the stable paper sheet guiding. Due to the improved efficiency of the radial ventilator it can be used more energy efficiently, the driving means can have a lower power and costs and space requirements for the driving means can be reduced.

In accordance with a further feature of the invention, the ventilator blades of the radial ventilator are disposed in a ring concentric to the axis of the paper sheet guiding cylinder, and there is provided a cylindrical channel being disposed annularly within the ventilator blades, extending axially and terminating axially in the inlet nozzles. This embodiment facilitates an additional improvement in the supply of air.

In accordance with an added feature of the invention, the radial ventilator includes a shaft mounted concentrically in the paper sheet guiding cylinder, and two circular carrier plates mounted concentrically on the shaft, the carrier plates each having the inlet nozzles for supplying blowing air to the channel, and the ventilator blades being mounted between and on the carrier plates. In this way, a stable, even supply of air over the full width of the paper sheet guiding cylinder is facilitated.

In accordance with an additional feature of the invention, the paper sheet guiding cylinder has a given width, and there is provided a shaft having an axis and being rotatably mounted concentrically to and in the paper sheet guiding cylinder, and one or two closely interspaced carrier plates mounted concentrically on the shaft in the middle of the given width, the one or two carrier plates have lateral surfaces being opposite lateral surfaces if two carrier plates are used, and the ventilator blades being mounted on the lateral surfaces, being extended parallel to the shaft axis and being disposed concentrically about the shaft. This embodiment facilitates a stable, even supply of blowing air over the full width of the paper sheet guiding cylinder with particularly simple preferred means.

In accordance with yet another feature of the invention, the radial ventilator has a drive shaft mounting the radial ventilator concentrically to the paper sheet guiding cylinder, the paper sheet guiding cylinder has a shaft journal, the drive shaft has an extension being extended through the shaft journal on one side of the paper sheet guiding cylinder through one of the side frames to the exterior, and the extension is drivingly connected to the driving means outside the one side frame. Not only does this embodiment facilitate a particularly simple preferred driving connection for the radial ventilator, but since the driving means can be disposed completely outside the side frame of the machine they therefore do not obstruct the already confined space between the side frames or walls of the machine. The driving means are easily accessible. The control circuit for the driving means can be constructed to be particularly simple.

In accordance with yet a further feature of the invention, there are provided sprockets, gripper chains having two spans passing over the sprockets and having gripper rails, the outer casing of the paper sheet guiding cylinder having an angular paper sheet guiding region, the gripper rails passing around the side walls of the paper sheet guiding cylinder at least over the paper sheet guiding region, the side frames having inner surfaces, the independently controllable driving means being disposed on the inner surface of one of the side frames between the two spans of the gripper chains, and the radial ventilator having a shaft being mounted concentrically to the sprockets and being drivingly connected to the driving means. This constitutes a further embodiment of the driving connection.

In accordance with yet an added feature of the invention, the driving means has means for varying a direction of rotation of the radial ventilator. This form of the invention constitutes a further tensioning of the transported paper sheets by the blowing air moving counter to the direction of transport of the paper sheets. This proves to be especially beneficial for the short-term machine stop in particular.

In accordance with a concomitant feature of the invention, the radial ventilator has a direction of rotation being contrary to a direction of rotation of the paper sheet guiding cylinder. In the preferred form of this embodiment the direction of rotation of the radial ventilator is reversible. This facilitates the optimum matching of the supply of blowing air to the print job profile. In particular, the change from very thin paper sheets to very thick paper sheets and vice versa can be carried out particularly stably with this embodiment.

Other features which are considered as characteristic for the invention are set forth in the appended claims.

Although the invention is illustrated and described herein as embodied in a paper sheet guiding cylinder for a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
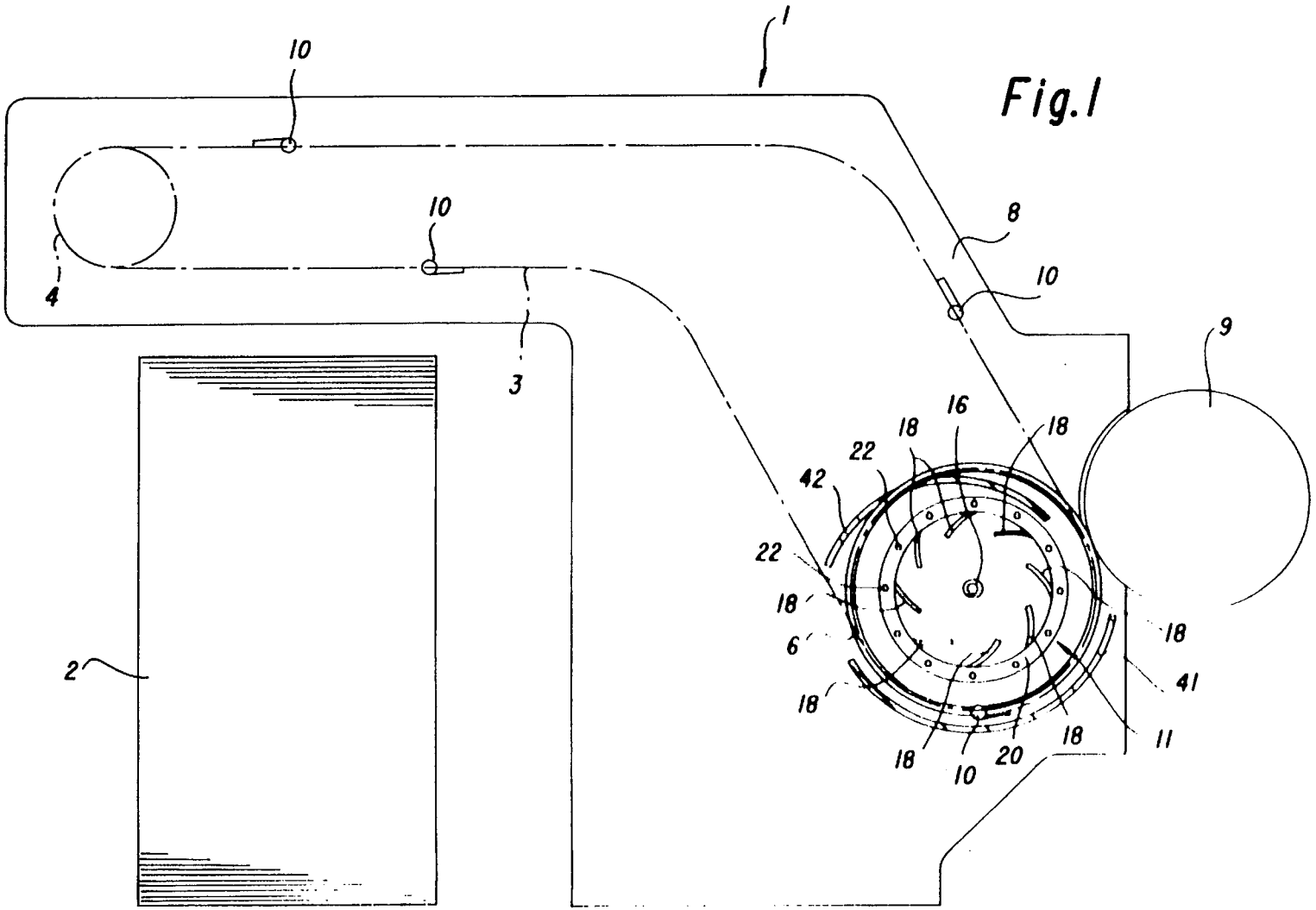
FIG. 1 is a diagrammatic, side-elevational view of a chain delivery device with a motor for a radial ventilator disposed outside side frames of the machine.
Figure 2:
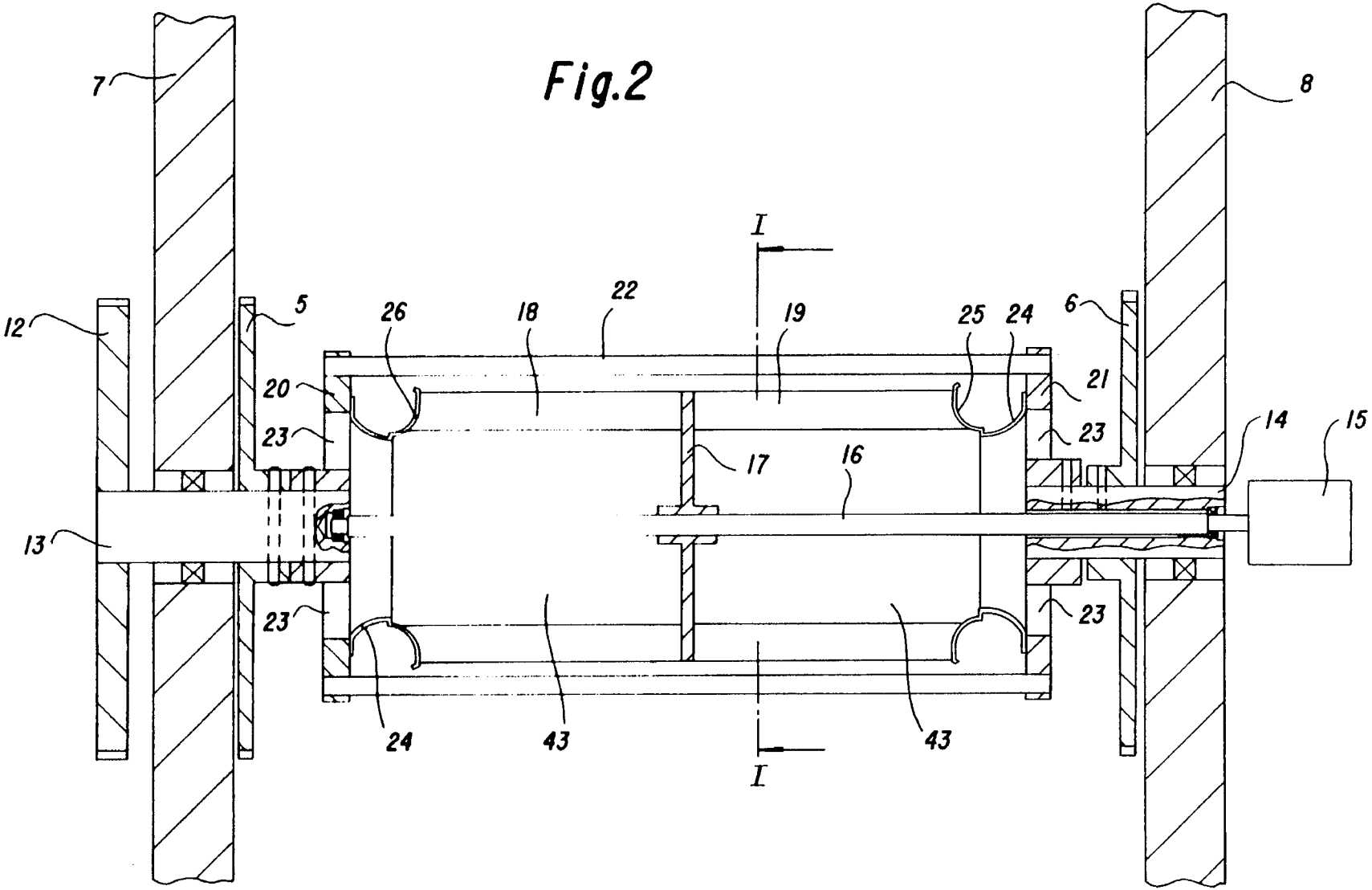
FIG. 2 is a fragmentary, partly sectional plan view of the embodiment according to FIG. 1.

Referring now to the figures of the drawing in detail and first, particularly, to FIGS. 1 and 2 thereof, there is seen a delivery device 1 of a paper sheet rotary offset printing machine in which printed paper sheets from a printing cylinder 9 of the last printing unit are accepted by gripper rails 10 attached to chains 3 and are transported over a delivery stack 2 where they are stacked. The gripper rails are carried on two chains 3 between side frames 7 and 8. In the vicinity of a delivery drum or guiding cylinder 11, the chains 3 are each guided continuously over sprockets 5 and 6. The sprocket 5 is attached to a stub shaft 13 that is rotatably mounted in the side frame or wall 7 and has an extension on which a sprocket 12 is attached outside the side frame 7. The sprocket 12 is connected with a non-illustrated printing machine drive. The sprocket 6 is also rotatably mounted on a stub shaft 14 in the machine side frame 8 so as to be concentric with the sprocket 5. The stub shaft 14 is constructed to be a hollow shaft. A shaft 16 is rotatably mounted concentrically to the stub shafts 13 and 14, has a shaft journal and is extended through the hollow stub shaft 14 to the exterior. A motor 15 is mounted on an extension outside the machine side frame 8 and is supported against the machine side frame in a known manner. The shaft 16 runs transversely to the paper sheet transport direction and is rotatably mounted at another shaft journal in the stub shaft 13. A circular carrier flange 17 which is mounted on the shaft 16 in the middle of the machine width has an outer circumferential region in which evenly spaced deflector blades 18 and 19 for radial ventilation are attached on both sides towards the machine side frames 7 and 8, over the circumference of the carrier flange 17. The deflector blades or plates 18 and 19 extend towards the exterior over the full transport width and are provided at their extremities with annular plates 25 and 26 oriented concentrically to the shaft 16. Circular flanges 20 and 21 are also attached on the stub shafts 13 and 14 between the sprockets 5 and 6. Towards the center of the machine, inlet nozzles 24 are mounted on the flanges 20 and 21 so as to be concentric to the shaft 16. These nozzles connect a ring channel 43 located within the deflector blades 19 between the deflector blades 19 and the shaft 16 with the atmosphere by means of through holes 23 which are distributed over the circumference of the flanges 21 and 20. Crossbars 22 are also attached to the flanges 20 and 21, are spaced about their circumference and are disposed at a greater radius than the deflector blades 19. These crossbars extend across the full with width between the two flanges 20 and 21.

Paper sheets that are transferred from the printing cylinder 9 to the gripper rails 10 on the continuous chains 3 are transported by the gripper rails 10 between guide plates 41 that are mounted in the side frames 8, 7 and an outer surface of the crossbars 22 on the delivery drum 11. To this end the chains 3 are driven by the printing machine drive across the sprocket 12, the stub shaft 13, the flange 20, the crossbars 22, the flange 21 and the sprockets 5 and 8. Independently of this, the deflector blades 18 and 19 are driven by means of the motor 15 through the shaft 16 and the flange 17. The deflector blades on the radial ventilator draw suction air through the through holes 23 in the flanges 20 and 21, across the inlet nozzles 24, into the channels 43 and discharge it radially and circumferentially as blowing or blown air to the exterior. In this way an adequate cushion of air for stable paper sheet guiding can be achieved over the entire circumference of the delivery drum. Desired operating profiles can be set steplessly with the aid of a motor controller for the motor 15.

It is possible to use a motor 15 that is variable in its direction of drive. In this way, if necessary, it is possible to orient blowing air counter to the direction of transport of the paper sheets, as a result of which the trailing edge of the paper sheet is slightly tensioned against the leading edge of the paper sheet that is held by the gripper rails and as a result of which flutter effects can also be prevented. Even in the event of a machine stop, the motor 15 can continue to drive the deflector blades 19 and 18, thereby sustaining the cushion of air.

In order to improve efficiency it is also conceivable to attach an additional guide plate 42 above the delivery drum and between the side frames of the machine, for example to isolate the remaining delivery area from the blowing air as well as the transport area of the printing cylinder.

Figure 3:
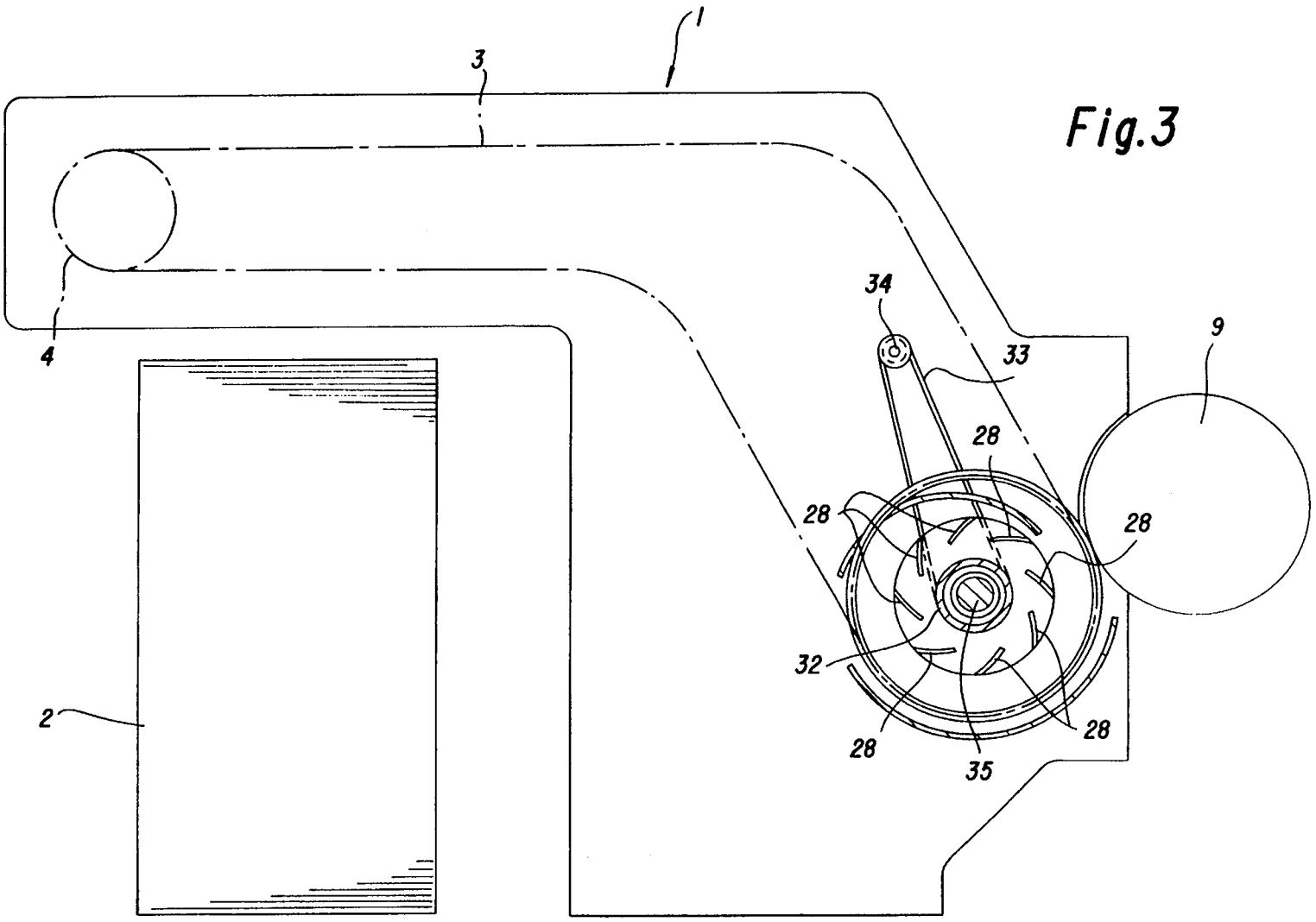
FIG. 3 is a side-elevational view of a chain delivery device with a motor disposed between the side frames.
Figure 4:
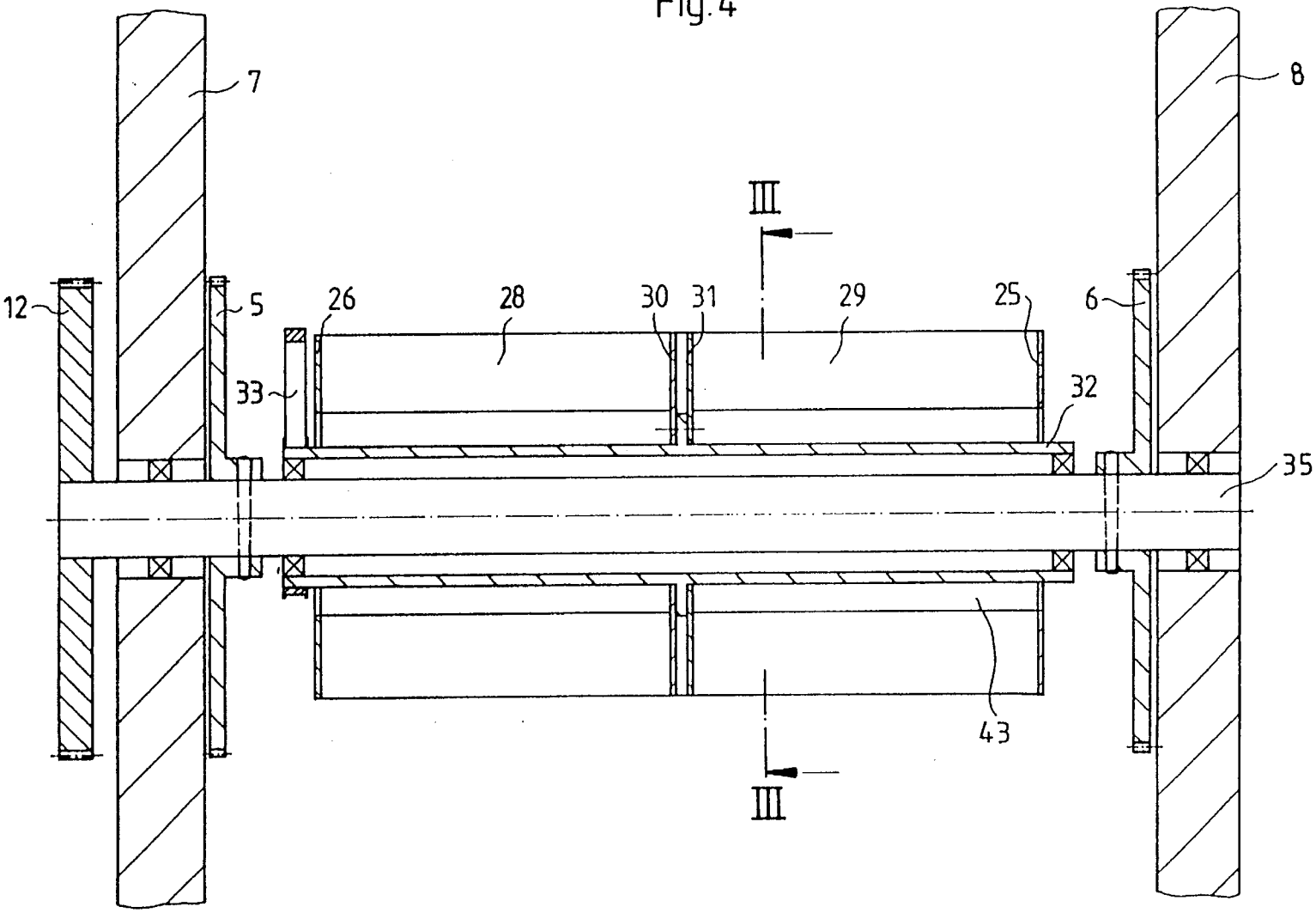
FIG. 4 is a fragmentary, partly sectional plan view of the embodiment according to FIG. 3.

FIGS. 3 and 4 illustrate another embodiment of the invention. The sprockets 5 and 6 are stationary fitted on a shaft 35 that is rotatably mounted in the machine side frames 7 and 8 and runs transverse to the paper sheet transport direction. The shaft 35 is extended through the machine side frame 7 towards the exterior and is in connection with the printing machine drive by means of a sprocket 12 that is mounted on it. A hollow shaft 32 is rotatably mounted between the sprockets 5 and 6 on the shaft 35 and is coaxially to it. Two flanges 30, 31 are mounted on the hollow shaft 32 in the middle of the machine width. Deflector plates 28 and 29 are mounted at ends of the flanges 30, 31 facing the side frames 7 and 8 for radial ventilation. The deflector plates 28 and 29 are coaxial to the shaft 35 and evenly spaced over the outer circumference of the flanges 30 and 31. Extreme ends of the deflector plates 28 and 29 are in turn attached to annular plates 25, 26 oriented coaxially to the shaft 35. Between the annular plate 26 and the sprocket 5 the hollow shaft 32 is connected by means of a drive belt 33 to a driven shaft 34 which is in turn connected to an independent drive motor. In this case again, the radial ventilator formed by the deflector plates 28, 29 sucks air from the atmosphere between the sprockets 5, 6 and the annular plates 25, 26 through the channel 43 formed between the deflector plates 28, 29 and the hollow shaft 32 and discharges it to the atmosphere as blowing air in the direction of the paper sheet guiding plane.

Instead of the drive bell 33 it is also conceivable to use a chain or a sprocket drive.

Figure 5:
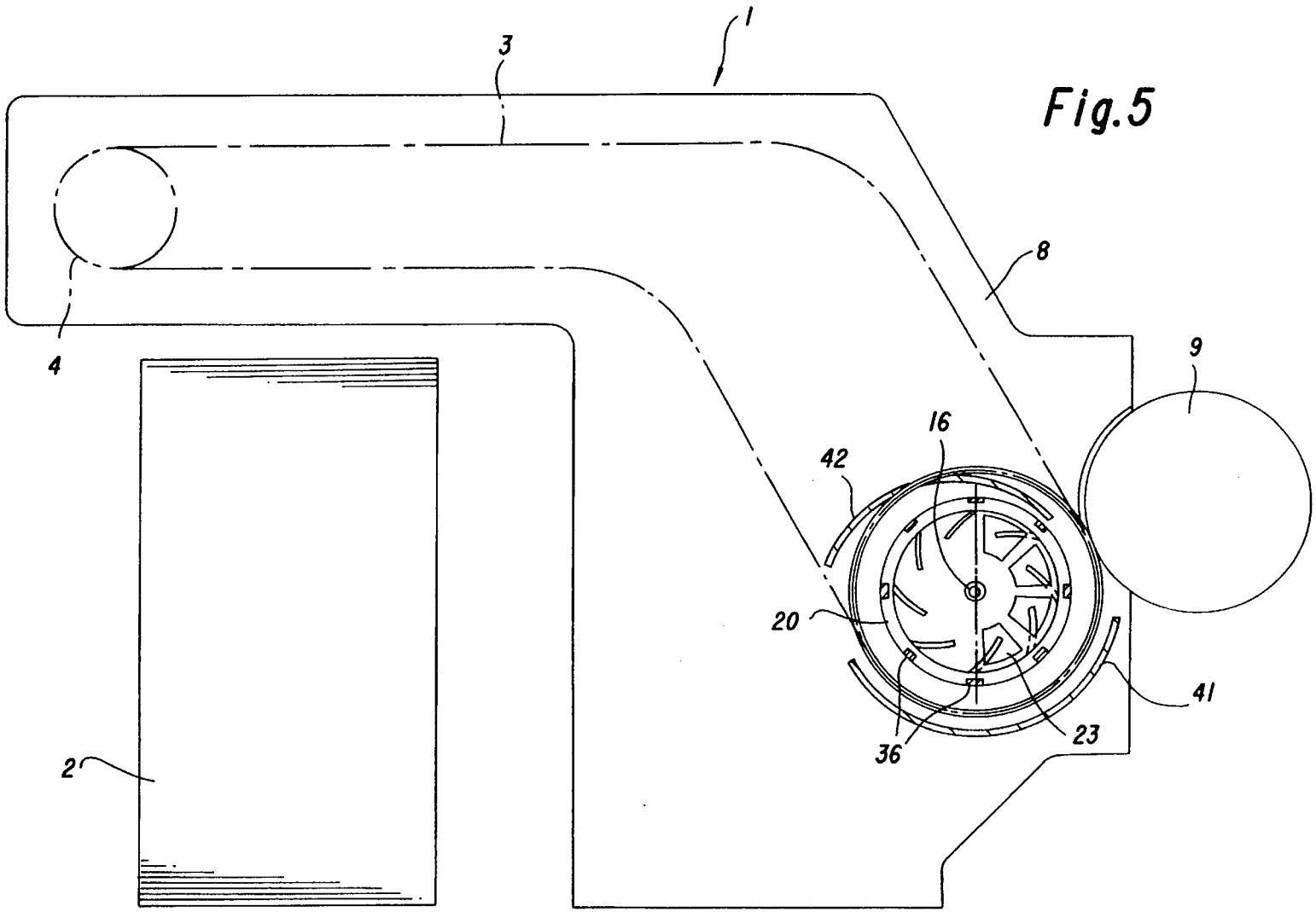
FIG. 5 is a side-elevational view of a further embodiment which is driven from the exterior.
Figure 6:
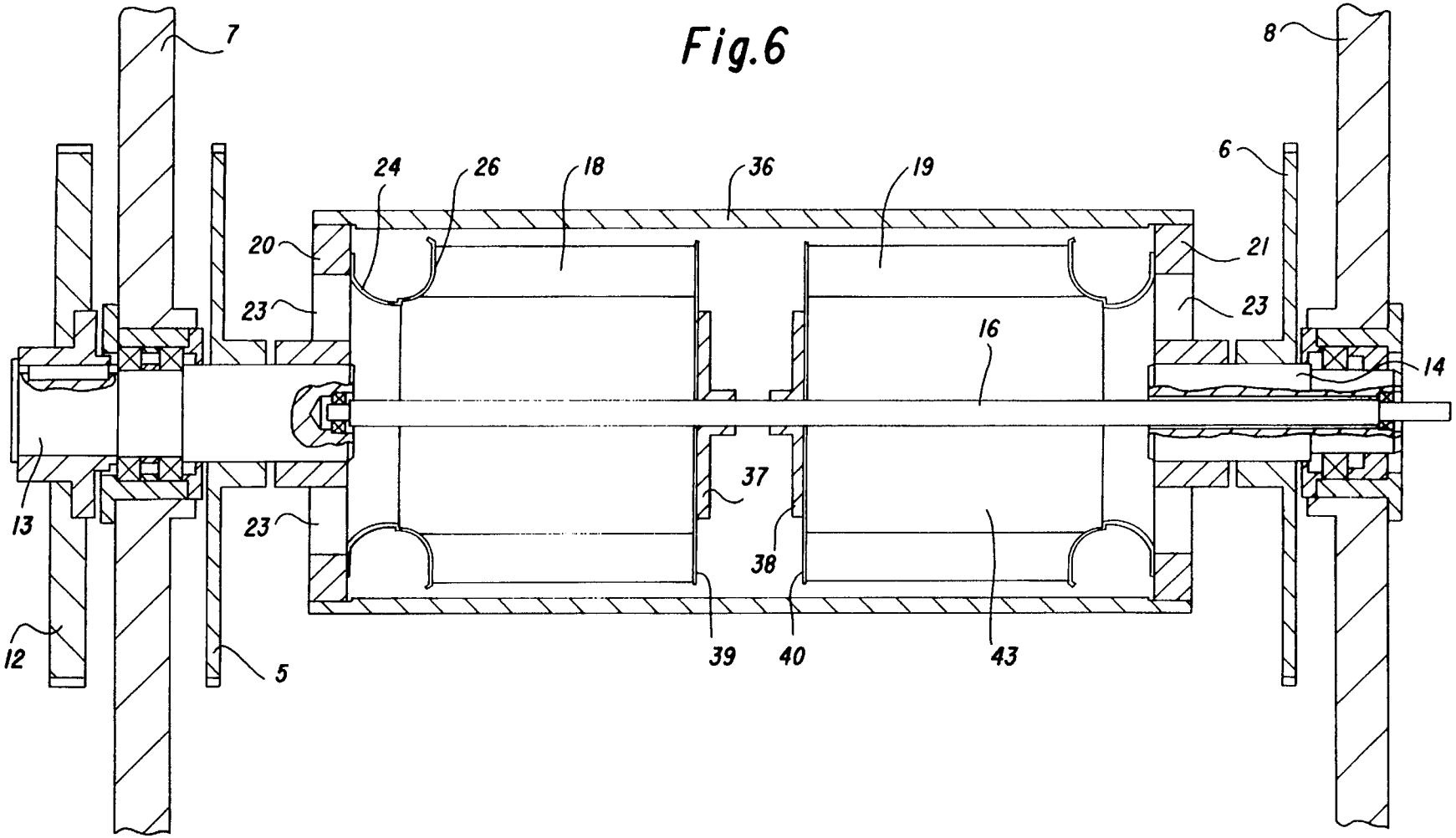
FIG. 6 is a fragmentary, partly sectional plan view of the embodiment according to FIG. 5.

In the embodiment of FIGS. 1 and 2, it is equally conceivable to use crossbars 36 with a rectangular section as illustrated in FIGS. 5 and 6, instead of the crossbars 22 with a circular section. The crossbars can also be matched to the aerodynamic requirements.

As is illustrated in FIG. 6, in order to provide easier assembly, the configuration of the deflector plates, an example of which is shown in the second embodiment of FIGS. 3 and 4, can also be provided with the aid of two flanges 37 and 38 that are shown at an exaggerated distance apart. Carrier plates 39, 40 are attached at outer sides of the flanges 37 and 38. The carrier plates 39, 40 have a circumferential region within which the deflector plates 18, 19 are mounted, as on the carrier plates 30, 31 in FIG. 4. As is illustrated in FIG. 6, this configuration is conceivable both with the drive according to the first embodiment of FIGS. 1 and 2, and with the second embodiment of FIGS. 3 and 4 in which the flanges 30 and 31 are mounted on the hollow shaft 32.

We claim:

1. In a printing machine having side frames and a printing machine drive, a paper sheet guiding cylinder assembly comprising:

a paper sheet guiding cylinder being mounted in the side frames of the printing machine and being drivingly connected to the printing machine drive;

said paper sheet guiding cylinder having an axis;

said paper sheet guiding cylinder including a cylinder jacket and side walls with through holes formed therein;

said paper sheet guiding cylinder housing a rotatably mounted radial ventilator being coaxial with the axis of said paper sheet guiding cylinder for supplying blowing air into said paper sheet guiding cylinder and for deflecting the blowing air inside said paper sheet guiding cylinder towards said cylinder jacket, said radial ventilator communicating with the ambient air through said holes, and said radial ventilator having ventilator blades disposed concentrically about the axis of said paper sheet guiding cylinder and extending along the paper sheet guiding cylinder; and means being independent of said paper sheet guiding cylinder for driving said radial ventilator with adjustable speed.

2. The paper sheet guiding cylinder assembly for a printing machine according to claim 1, wherein said radial ventilator has sides facing said side walls of said paper sheet guiding cylinder and at least one inlet nozzle non-rotatably connected with said radial ventilator on at least one of said sides of said radial ventilator.

3. The paper sheet guiding cylinder assembly for a printing machine according to claim 2, wherein said ventilator blades of said radial ventilator are disposed in a ring concentric to the axis of said paper sheet guiding cylinder, and including a cylindrical channel being disposed annularly within said ventilator blades, extending axially and terminating axially in said at least one inlet nozzle.

4. The paper sheet guiding cylinder assembly for a printing machine according to claim 3, wherein said radial ventilator includes a shaft mounted concentrically in said paper sheet guiding cylinder, and two circular carrier plates mounted concentrically on said shaft, said carrier plates each having said inlet nozzles for supplying blowing air to said channel, and said ventilator blades being mounted between and on said carrier plates.

5. The paper sheet guiding cylinder assembly for a printing machine according to claim 3, wherein said paper sheet guiding cylinder has a given width, and including a shaft having an axis and being rotatably mounted concentrically to and in said paper sheet guiding cylinder, and at least one carrier plate mounted concentrically on said shaft in the middle of said given width, said at least one carrier plate having lateral surfaces, and said ventilator blades being mounted on said lateral surfaces, being extended parallel to the shaft axis and being disposed concentrically about said shaft.

6. The paper sheet guiding cylinder assembly for a printing machine according to claim 5, wherein said at least one carrier plate are two mutually spaced-apart carrier plates having opposite lateral surfaces on which said ventilator blades are mounted.

7. The paper sheet guiding cylinder assembly for a printing machine according to claim 1, wherein said radial ventilator has a drive shaft mounting said radial ventilator concentrically to said paper sheet guiding cylinder, said paper sheet guiding cylinder has a shaft journal, said drive shaft has an extension being extended through said shaft journal on one side of said paper sheet guiding cylinder through one of said side frames to the exterior, and said extension is drivingly connected to said driving means outside said one side frame.

8. The paper sheet guiding cylinder assembly for a printing machine according to claim 1, including sprockets, gripper chains having two spans passing over said sprockets and having gripper rails, said cylindrical jacket of said paper sheet guiding cylinder having an angular paper sheet guiding region, said gripper rails passing around said side walls of said paper sheet guiding cylinder at least over said paper sheet guiding region, said side frames having inner surfaces, said independently controllable driving means being disposed on said inner surface of one of said side frames between said two spans of said gripper chains, and said radial ventilator having a shaft being mounted concentrically to said sprockets and being drivingly connected to said driving means.

9. The paper sheet guiding cylinder assembly for a printing machine according to claim 1, wherein said driving means has means for varying a direction of rotation of said radial ventilator.

10. The paper sheet guiding cylinder assembly for a printing machine according to claim 1, wherein said radial ventilator has a direction of rotation being contrary to a direction of rotation of said paper sheet guiding cylinder.

* * * * *